US008669876B2

(12) United States Patent
Anderson et al.

(10) Patent No.: US 8,669,876 B2
(45) **Date of Patent: *Mar. 11, 2014**

(54) ABOVE-WATER MONITORING OF SWIMMING POOLS

(75) Inventors: David Bradford Anderson, Santa Barbara, CA (US); John Thomas Barnett, San Diego, CA (US); Donald Lee Hakes, Escondido, CA (US); Keith Roger Loss, San Diego, CA (US); James Paul Gormican, Poway, CA (US)

(73) Assignee: 1998 David B. and Ann E. Anderson Revocable Trust, Santa Barbara, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/539,764

(22) Filed: Jul. 2, 2012

(65) Prior Publication Data

US 2012/0269399 A1 Oct. 25, 2012

Related U.S. Application Data

(63) Continuation of application No. 12/479,744, filed on Jun. 5, 2009, now Pat. No. 8,237,574.

(60) Provisional application No. 61/059,001, filed on Jun. 5, 2008, provisional application No. 61/084,078, filed on Jul. 28, 2008.

(51) Int. Cl.
*G08B 23/00* (2006.01)

(52) U.S. Cl.
USPC ..... 340/573.6; 340/541; 382/103; 382/107; 348/167; 348/143

(58) Field of Classification Search
USPC ..... 340/573.6, 541; 382/103, 107; 348/169, 348/143
See application file for complete search history.

(56) References Cited

U.S. PATENT DOCUMENTS

| | | | | |
|---|---|---|---|---|
| 5,043,705 | A | 8/1991 | Rooz | |
| 5,448,936 | A * | 9/1995 | Turner | 89/1.13 |
| 5,638,048 | A | 6/1997 | Curry | |
| 5,886,630 | A | 3/1999 | Menoud | |
| 5,953,439 | A * | 9/1999 | Ishihara et al. | 382/107 |
| 6,133,838 | A | 10/2000 | Meniere | |
| 6,304,664 | B1 * | 10/2001 | Silva et al. | 382/100 |
| 6,839,082 | B2 | 1/2005 | Lee | |
| 7,050,177 | B2 | 5/2006 | Tomasi | |
| 7,330,123 | B1 | 2/2008 | Grahn | |
| 7,340,077 | B2 | 3/2008 | Gokturk | |
| 2003/0215141 | A1 * | 11/2003 | Zakrzewski et al. | 382/190 |
| 2007/0273765 | A1 | 11/2007 | Wang | |
| 2008/0048870 | A1 | 2/2008 | Laitta | |
| 2010/0002222 | A1 * | 1/2010 | Lubard et al. | 356/4.01 |

* cited by examiner

*Primary Examiner* — Steven Lim
*Assistant Examiner* — Hongmin Fan
(74) *Attorney, Agent, or Firm* — William H. Eilberg

(57) ABSTRACT

An above-water system provides automatic alerting for possible drowning victims in swimming pools or the like. One or more electro-optical sensors are placed above the pool surface. Sequences of images are digitized and analyzed electronically to determine whether there are humans within the image, and whether such humans are moving in a manner that would suggest drowning. Effects due to glint, refraction, and variations in light, are offset automatically by the system. If a potential drowning incident is detected, the system produces an alarm sound, and/or a warning display, so that an operator can determine whether action must be taken.

7 Claims, 6 Drawing Sheets

Pool Monitoring Sensor Configuration

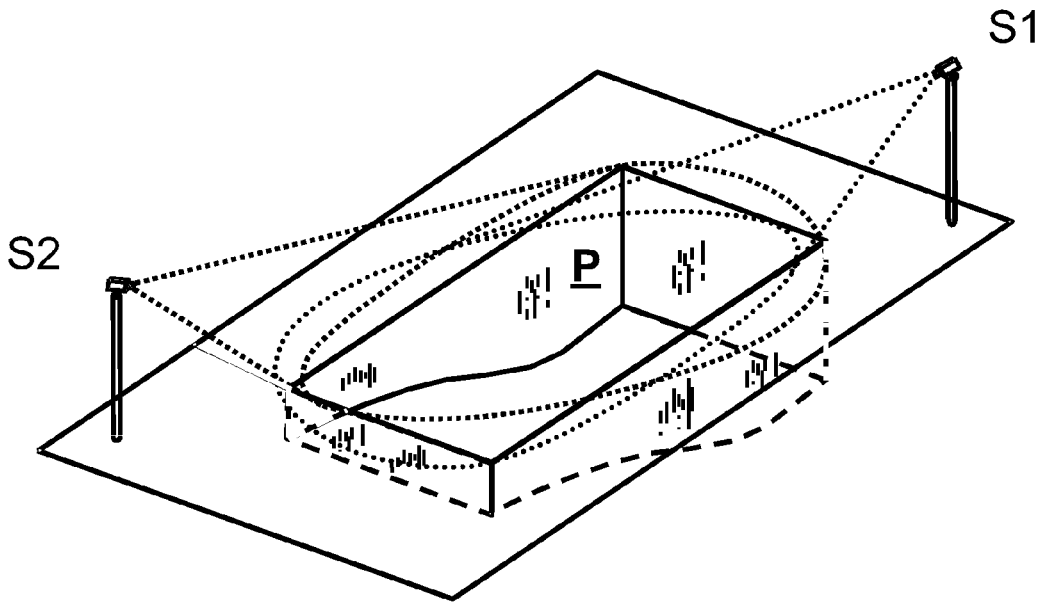
Figure 1. Pool Monitoring Sensor Configuration

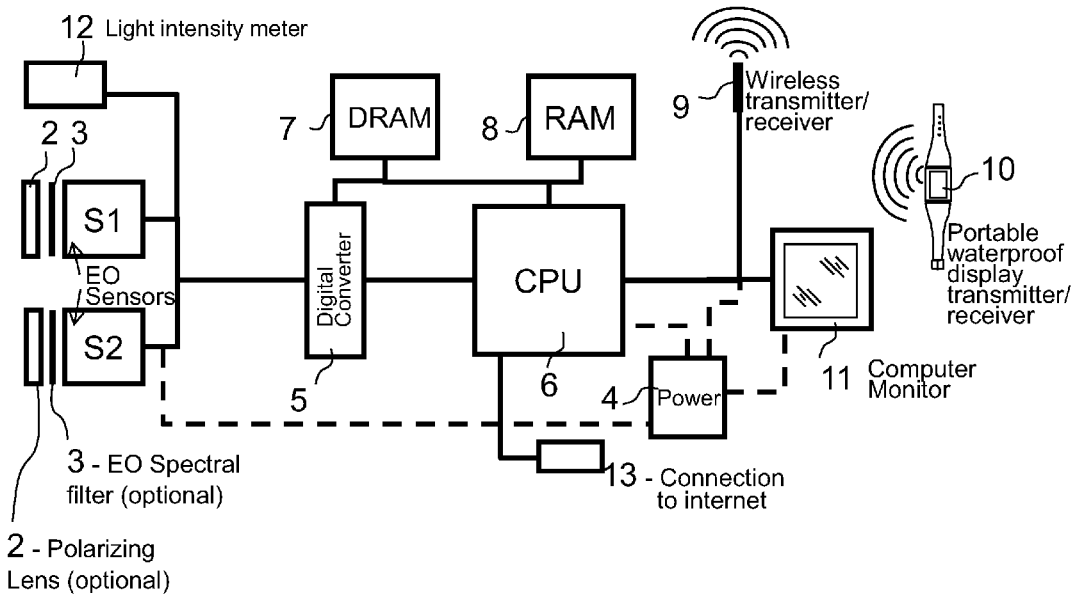
Figure 2. System Hardware Configuration

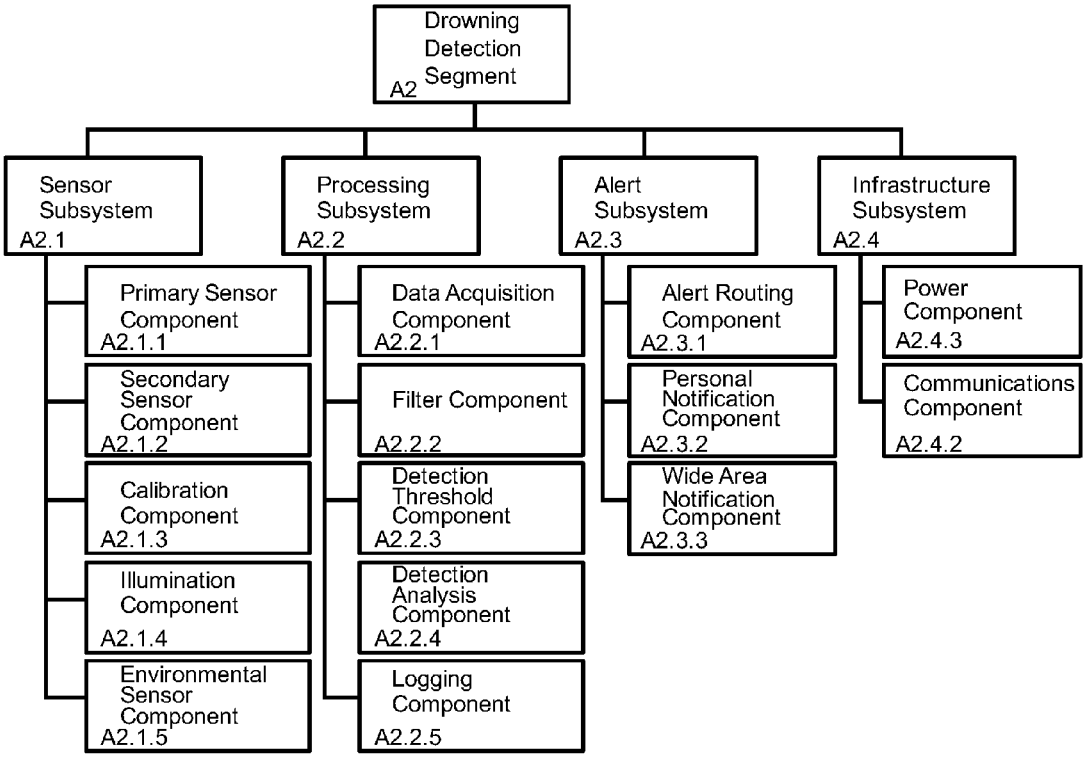
Figure 3. Drowning Detection Architecture

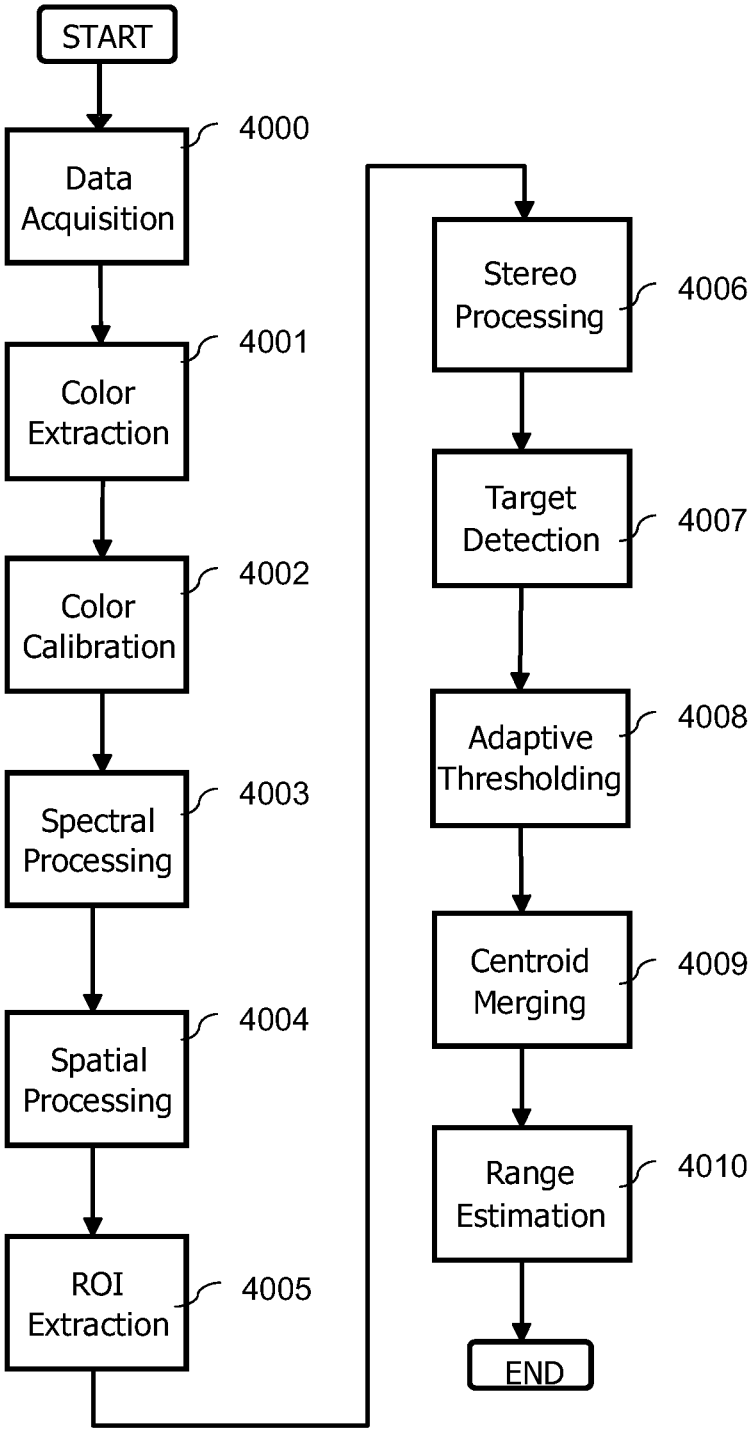
Figure 4. Drowning detection processing

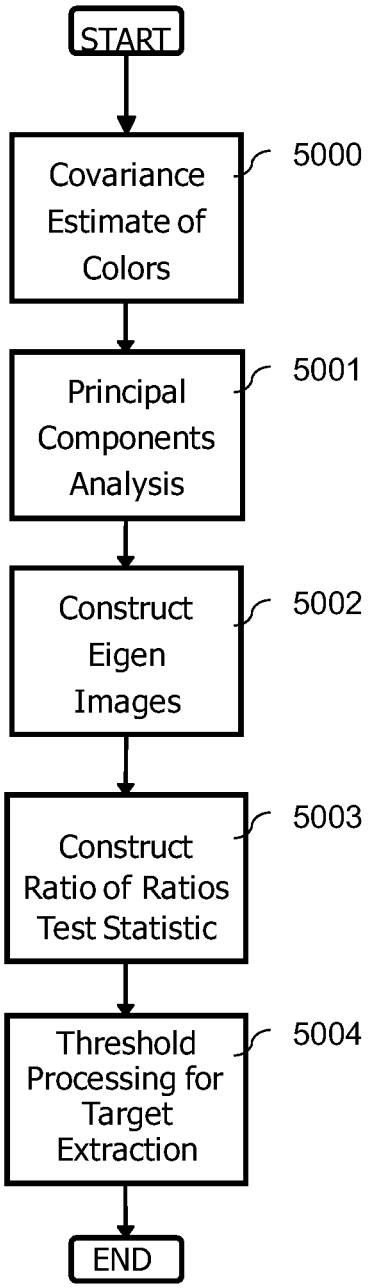
Figure 5. Processing steps for performing spectral processing

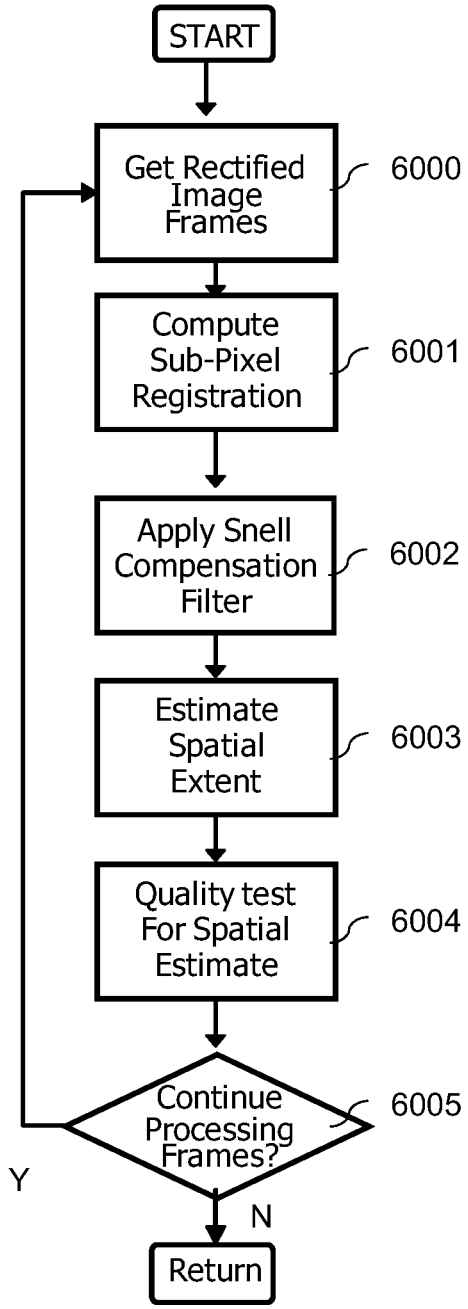
Figure 6. Processing steps for performing stereo processing

ABOVE-WATER MONITORING OF SWIMMING POOLS

CROSS-REFERENCE TO PRIOR APPLICATIONS

This is a continuation of U.S. patent application Ser. No. 12/479,744, filed Jun. 5, 2009.

Priority is claimed from U.S. provisional patent application Ser. No. 61/084,078, filed Jul. 28, 2008, entitled "Above-water System for Alerting of Possible Drowning Victims in Pools of Water", the entire disclosure of which is incorporated by reference herein.

BACKGROUND OF THE INVENTION

The present invention relates generally to the field of automated monitoring of swimming pools, and the like, to detect possible drowning victims. More specifically, the invention relates to systems which use only sensors that are above the water line, to alert responsible persons monitoring a pool of water, by detecting behaviors consistent with those of someone who is unconscious or otherwise incapacitated.

Devices for automated monitoring of swimming pools have been known in the prior art. Such devices have employed video or other sensor technologies, such as sonar. Examples of such devices are given in U.S. Pat. Nos. 6,133,838, 7,330,123, and 5,043,705, the disclosures of which are incorporated by reference herein.

The above-described prior-art devices are limited in their functionality, in that all require the mounting of sensors below the surface of the water. Mounting the sensors below the surface requires a more costly and disruptive installation procedure, requiring the routing of power and data wires underwater, or through the pool walls, back to the sensor processing hardware. Also, the systems of the prior art require extensive or cumbersome calibration methods or algorithms to reduce false alarm rates.

In U.S. Pat. No. 6,133,838, there is described a system using underwater cameras mounted to the walls of a swimming pool. Underwater cameras have an advantage in seeing underwater objects and humans without the obscurations caused by the surface refraction effects at the air-water interface. However, the use of such a system involves the cost and complications of draining the pool, drilling large holes into the pool wall, installing watertight video camera housings, and excavating behind the wall to route wires to the cameras.

Moreover, in the above-described system, because the underwater cameras must be flush with the wall contours, the system has blind spots immediately adjacent to the pool walls, especially near the cameras. The prior art system must accept these disadvantages as the price for avoiding the additional signal processing needed to extract useful images if the cameras were mounted above the water surface.

U.S. Pat. No. 7,330,123 discloses sonar devices mounted underwater on the pool walls, and/or the pool bottom, to scan for objects and humans displaying characteristics of interest. These are active sensors, as contrasted with the passive sensors of the present invention. Pool-mounted active sensors are likely to be accidentally dislodged or blocked by swimmers, thus disabling one or more of the sensors. The system also requires that a person with an active sensor be in the pool, to support calibration of the overall system for different numbers of swimmers and/or levels of activity.

U.S. Pat. No. 5,043,705 uses a similar active sonar system to scan the surfaces within the volume of a pool, to generate images from which the system can discern objects and humans who are stationary. As in the above-described patent, its sensors are vulnerable to accidental dislodgment and/or blockage by swimmers.

The sonar systems of the prior art could not be mounted above the water surface. The problems of the video-based prior art could theoretically be avoided by providing sensors above the pool. However, the prior art has taught against doing so, because of the intractable problems encountered.

Specifically, the air-water boundary presents a number of challenges to sensing algorithms and makes it impractical simply to move an underwater system to a position above the water line. A water surface has small surface waves, creating a roughened water surface, akin to a rough ocean on a small scale. This surface acts as a series of small areas with slightly different refraction properties, producing the fractured and distorted view seen when observing objects underwater. Objects appear disjointed to an observer and often are missing segments due to changes in surface refraction distorting and breaking up the sensed image of underwater objects.

Moreover, varying water quality and lighting conditions alter the sensed image of the water being monitored, adding to the difficulty of using above-pool sensors.

Sensors mounted underwater do not have to deal with glare on the surface of water, or surface refraction. Further, underwater sensors are oriented to resolve the up and down motion of swimmers, while above water sensors are usually positioned at a more oblique angle, and must use passive ranging techniques to monitor motion in the critical vertical axis. For these reasons, it is impractical simply to move an underwater system of the prior art to a position above the water line.

It is the purpose of the present invention to overcome the above problems, and to provide a practical system and method for monitoring a swimming pool from above the pool. The present invention provides a new and useful above-water pool-monitoring system which is simpler in construction, more universally usable, and more versatile in operation than the devices of the prior art.

SUMMARY OF THE INVENTION

The present invention provides an automated pool monitoring system which includes sensing objects through the air, the air-water interface, and the water itself. The present invention uses passive electro-optical sensors that are mounted only above the water surface, and near the pool perimeter.

The present invention uses passive ranging techniques to estimate the three-dimensional location of objects on or under the surface of the pool. Further, the invention uses spectral processing to account for variations in lighting and water quality conditions, and uses spatial processing to untangle the distortions introduced by the roughened water surfaces. Finally, the present invention employs one or more polarizing lenses and/or special spectral filters to overcome glare, shadows and the like.

Together, the above-described procedures overcome the limitations which have prevented devices of the prior art from being moved from below the water line to a position above the pool. The present invention overcomes the effects of surface distortions to reconstruct an undistorted view of underwater swimmers.

The present invention alerts responsible persons monitoring a swimming pool concerning the possibility that someone may be drowning. The invention provides an alert in the form of a sound and a visual display, enabling the operator to assess the location which caused the alert. The operator can then determine whether action must be taken, and turn off the alert from any remote display.

The system includes one or more electro-optical (EO) sensors mounted above the surface of the pool. The EO sensors are mounted at a height above the water surface that provides an adequate angle of view that includes a significant portion of the water surface and the pool bottom surface at a resolution consistent with the overall system fidelity.

The process of the present invention comprises at least three basic, interrelated parts, namely 1) spectral processing, 2) spatial processing, and 3) temporal processing. The spectral processor decomposes each digital image into principal components, for the purpose of enhancing contrast, or signal-to-noise ratio. The output from the spectral processor is fed to the spatial processor, which searches for particular, tell-tale shapes in each image. The output of the spectral processor is fed into a temporal processor, which analyzes a sequence of images, especially a sequence of images containing the shapes of interest, to detect movements (or lack thereof) that may indicate drowning.

In addition to the above, the system is programmed to compare sequential images to determine which pixels, if any, are artifacts due to glint. Such pixels can be discarded to improve the quality of the images.

The present invention therefore has the primary object of providing a system and method for monitoring a pool, and for warning of the possibility that someone is drowning.

The invention has the further object of providing a system and method as described above, wherein the system uses passive sensors which are mounted above the surface of the pool.

The invention has the further object of providing a system and method as described above, wherein the system overcomes the problems of distortions inherent in viewing objects in a pool, from a viewpoint above the surface of the pool.

The invention has the further object of reducing the cost, and improving the reliability, of systems and methods for monitoring pools for possible drowning victims.

The reader skilled in the art will recognize other objects and advantages of the present invention, from a reading of the following brief description of the drawings, the detailed description of the invention, and the appended claims.

BRIEF DESCRIPTION OF THE DRAWINGS

FIG. 1 provides a perspective view of an above-water system for warning of possible drowning victims in pools of water, according to the present invention.

FIG. 2 provides a schematic and block diagram, showing the hardware configuration for the system of the present invention.

FIG. 3 provides a block diagram illustrating the architecture of the system of the present invention.

FIG. 4 provides a block diagram illustrating the processing algorithms used in the present invention, for detecting possible drowning victims in a swimming pool.

FIG. 5 provides a flow chart illustrating the steps for performing spectral processing for the system of the present invention.

FIG. 6 provides a flow chart illustrating the performance of stereo processing for the system of the present invention.

DETAILED DESCRIPTION OF THE INVENTION

In the following description of an above-water system for monitoring pools for possible drowning victims, reference is made to the accompanying drawings forming a part thereof. These drawings show by way of illustration, a specific embodiment in which the invention may be implemented. Other embodiments may be utilized and structural changes may be made without departing from the scope of the present invention.

In this specification, the term "video" is defined as a series of time sequenced electro-optical CEO) images within a portion of the bandwidth of wavelengths from infra-red to ultraviolet energy. The EO sensors may be mounted on rigid poles, walls, or ceilings, or any combination thereof. The sensors receive video images of the pool surface including images of humans and objects within the water volume, at or below the surface.

The EO sensor housing may include a pair of apertures at a known separation distance providing stereoscopic images of the field of view. The stereoscopic images improve the accuracy of the estimated range of the targets being viewed, allowing for better determination of the depth of the humans being tracked in the field of view.

The EO sensors may include polarizing lenses and/or special spectral filters that transmit only certain portions of the electromagnetic spectrum. The polarizing lenses and/or filters aid in reducing reflections which obscure details of features within the image of the water within the field of view of the sensor.

The present invention overcomes the effects of 1) bright reflections, or glare, caused by the sun or artificial lights, 2) refraction of light caused by large or small ripples in the water, and 3) light refracted by small bubbles caused by agitation of the water.

A light intensity meter that measures the amount of light in the field of view may be co-located with each sensor housing. The light intensity information can aid the signal processing algorithms in determining the range of color contrast that is available, which, in turn, improves the accuracy with which one can detect which contours and/or colors are edges of the human form. Moreover, the system will alert when insufficient light is available, based on the light intensity meter readings, and will inform responsible persons that the system should not be used at that time. The system can then notify responsible persons, when the light level is again sufficient for video processing.

The video images captured by the system of the present invention are digitized and processed using computer algorithms to identify which objects within the field of view are humans, and to determine the three-dimensional coordinates of one or more points characterizing the location of each human. The digitized images are processed to remove additional remaining obscurations of feature details within the image. Sequential processed images are compared to determine if any human within the water volume is displaying the characteristics of a possible drowning victim.

For example, drowning characteristics to be detected could include a person exhibiting a downward vertical velocity with minimal velocity in the two orthogonal directions and minimal movement of arms or legs. If such characteristics are observed, the system will execute an alerting algorithm whereby a signal is sent to all active monitoring devices. That alert includes a display that indicates the location of the possible victim relative to various pool features (such as the pool perimeter, lane-marker tile patterns, etc.).

Portable alerting devices, to be worn on the wrist and/or around the neck of an operator, may be included as part of the present invention. Any active person monitoring the pool has the ability to observe the alert location in the pool to determine if the situation requires action. If the pool is being monitored remotely, the operator can view the live video images of pool from any of the EO sensors and make the same judgment regarding whether it is necessary to take action, or whether the alert should be turned off.

An embodiment of the system may include a connection to the Internet to allow for two-way communication between the user and the system provider. Each user system will download to a central processing site information such as: imagery of the pool scene to help with initialization and calibration of the system installation, and the time/location of alert events. The central processing unit will upload to the users information such as: calibration factors during initialization, any software upgrades/updates, and/or training information.

FIG. 1 provides a perspective view of the system of the present invention. In the system illustrated, there are two passive electro-optical (EO) sensors S1 and S2, mounted above the water level of the pool P. The sensors are therefore positioned to observe the entire volume of water in the pool. The number of sensors is not limited to two: in practice, additional sensors could be present.

FIG. 2 provides a schematic and block diagram of the hardware used in the present invention. Video images are received by the EO sensors S1 and S2. Polarizing lenses 2 and light filters 3 may be placed in front of the sensors to restrict the light reaching the sensors to a narrow band of the optical spectrum. A light intensity meter 12, for sensing the amount of light present in the field of view of the sensor, may be co-located with each sensor. Knowing the light intensity aids the signal processing algorithms in identifying contrasts that are identifiable as the edges of human bodies.

The image is converted to a digital signal in converter 5. In practice, the converter may be located within the sensor units S1 and S2. The digital signal is then transmitted to central processor unit (CPU) 6 and to dynamic random access memory (DRAM) 7. The CPU can be a microprocessor, or its equivalent.

The CPU performs processing algorithms to discern: a) humans who are in the water, b) whether the observed humans are showing behavior consistent with possible drowning, and c) how to indicate an alert to the monitoring person(s) or operator of the system.

Long-term memory device 8 stores processed and raw data, to allow for retrieval at a future time. All digitized image data can be transmitted to the CPU by way of either cables or a wireless network. Power supply 4 provides power to the EO sensors, and to the CPU and monitor, and could represent either a distributed source or local sources.

Central computer monitor 11 displays scene imagery, showing the scene of the pool as well as system status and any alerts and the zone in which the alert arose. Alert information may also be sent via a wireless connection 9, to a distributed network of devices 10, that sound an alarm, vibrate, and display a zone identification where a possible drowning event may be occurring.

Each of the distributed devices 10 has the ability to send back to the CPU an override signal if the person monitoring the pool determines that no action is needed. An Internet connection 13 can also be provided as another means for transferring data, relating to identified events and software upgrades, between each pool monitoring system and the system provider.

FIG. 3 shows the functions performed by the system of the present invention, in detecting possible drowning victims. Each of the illustrated functions is performed by one or more of the hardware components shown in FIG. 2, and/or by the CPU. The functions represented in FIG. 3 are together called the drowning detection segment, as represented in block A2.

Block A2.1 represents the Sensor Subsystem components. The primary sensor component, Block A2.1.1 represents the functions performed by an appropriately selected, commercially available video camera capable of taking and digitizing images at a rate of more than 2 images per second, at a resolution such that one pixel covers a small enough area to resolve human features such as a child's hand.

The image received by the primary sensor component may be filtered using lenses, to receive only energy of a single polarization, and/or one or more, specific, monochromatic bandwidth(s) of energy.

A sensor site may include more than one sensor at the same location, the second sensor being termed a secondary sensor component, as represented in Block A2.1.2. The secondary sensor component can be of the same type as the primary sensor component, and may have essentially the same field of view. The secondary sensor component can be configured to receive different types of polarized/filtered energy. The secondary sensor component could also view the scene from a different location, allowing for stereoscopic image processing.

All data received by the sensors must be calibrated with respect to the specific conditions under which the electro-optical image is received. Block A2.1.3 represents a calibration component. Calibration can be performed by comparing the amplitude, specific reflectance bandwidth, and resolution of known, constant features, that are printed, etched or otherwise made part of the protective lens for the sensor. Data from the light intensity meter also may be used in this module to aid in achieving the best contrast of the humans beings monitored. Images received of the pool scene can then be adjusted under the instantaneous lighting conditions to be consistent with the expected parameters of subsequent image processing algorithms.

If the calibration parameters indicate that the system is not receiving video images within the expected ranges, due to conditions such as insufficient ambient light, processing performed within the illumination component A2.1.4 of FIG. 3 will indicate the out-of-tolerance condition, and will alert the user that the system is not functioning.

The illumination component uses the output of a light meter, or "incident light sensor" (ILS), or its equivalent, to make a decision, based on the amount of light received, whether to continue the processing. When the amount of light received is acceptable, but above a given threshold, the system can be programmed to weight the components (i.e. the component colors) of the image so as to yield optimum results.

The environmental sensor component, represented in Block A2.1.5 of FIG. 3, monitors variations in the scene that may change due to seasonal or intermittent weather conditions. One example is the periodic imaging of a constant, known object within the pool scene itself to augment the calibration of the image data received by the sensors. The incident light sensor, discussed above, may be used in conjunction with this component.

Block A2.2 of FIG. 3 represents the processing subsystem of the present invention. The data acquisition component, Block A2.2.1, includes means for receiving the digitized video images at a known rate. Each digitized image frame is a matrix of pixels with associated characteristics of wavelength and brightness that are registered to the physical location within the scene as it is projected from the pool area. Each image frame is tagged with a time stamp, source, and other characteristics relating to the acquisition of that frame.

Within Block A2.2.2, the digitized image frames are then filtered to remove additional obscurations through signal processing methods such as, but not limited to, averaging, adding, subtracting image data of one frame from another, or by adjusting different amplitudes relating to the image contrast, brightness, or spectral balance. The detection threshold component A2.2.3 analyzes the processed image frames to detect which pixels within the registered frame are humans, and to determine the physical location coordinates of a representative point or points on the human.

The detection analysis component, represented in Block A2.2.4, compares the images within a specific time sequence to determine if the humans identified within the scenes are exhibiting behaviors consistent with those of a person who is apparently not moving or who has begun to sink toward the bottom of the pool. Such persons could be unconscious and could possibly be in danger of drowning.

Within Block A2.2.4, several other tests on the perceived behavior of any detected human are executed to reduce the number of false alarms. For example, a person standing on the pool bottom with his or her head above water would match the criterion of a non-moving swimmer. However, by also discerning from the images that the person's head is above water would indicate that no alert should be generated.

Block A2.2.5 represents the logging component, which simply stores the tagged image frames in random access memory (item 8 of FIG. 2) in the as-received and post-processed formats along with records of specific discrete, unique, noteworthy events, such as alerted events, or near-alert events, for possible subsequent diagnostic reviews.

If an alert condition is detected, the system then executes a procedure for activating audio, visual and vibrating stimuli to notify the monitoring person(s). Because the system knows the 3-dimensional coordinates of the targets, a zone within the pool area established as a grid overlay translates into unique identifiers for each zone corresponding to a specific location within the pool.

The alert signal will be sent to all alarm devices for that pool indicating the zone where the event is taking place. At a minimum, the alert device will include a large computer monitor (item 11 of FIG. 2) with a plan view image or rendering of the pool area and a flashing symbol in the corresponding zone where the event is occurring. Portable, distributed alert monitoring devices (such as item 10 of FIG. 2) could also be worn on the wrist or around the neck of a monitoring person. These devices would receive wireless signals from the system (as indicated by item 9 of FIG. 2) which would display similar information as displayed on a central monitor.

If the person monitoring the pool determines that the alert does not require action, i.e. if it was a false alarm, the person can cancel or override the alert through either by direct input to the central system, or by wirelessly transmitting an appropriate signal through a portable wireless device. If the alert is not overridden within a specified time period, the alert would also notify management personnel within the venue (through item 11 of FIG. 2). If an alert system is determined to be an actual drowning event that could require further emergency treatment, the system could notify local emergency responders through a system of manual or automatic processes.

The Infrastructure Subsystem components, represented in Block A2.4 of FIG. 3, include the power component, represented by Block A2.4.3, for supplying power to the sensors (items S1, S2 of FIG. 2), to the CPU and memory devices (items 5-8 of FIG. 2), to the central computer monitor (item 11 of FIG. 2), and to any wireless transmitting devices (item 9 of FIG. 2) connected directly to the central unit. Any portable alarm alert devices are preferably powered by internal batteries.

The Communications Component, represented in Block A2.4.2, includes the algorithms by which the alert information is formatted to communicate with the specific alerting devices for a specific system installation, including computer monitor (item 11 of FIG. 2) and any wireless communication devices such as item 9 of FIG. 2.

FIG. 4 provides a flow chart showing the data processing functions performed so as to detect swimmers above, at, and below the water's surface. The air-water boundary requires the removal of surface effects to isolate properly objects which are underwater, and to determine the location of the water's surface and thus determine whether an object is above or below said surface.

The images are acquired in Block 4000, and the constituent colors are extracted, in Block 4001, in order to correct each image from color calibration tables represented by Block 4002.

The views from each camera are slightly different, and thus two different cameras, which are purportedly identical, will respond slightly differently to the same input. Therefore, it is necessary to calibrate the cameras, in advance. Calibration is performed by using test colors and images having known properties. One illuminates a scene with a given level of illumination, and one takes images of the scene using the camera to be calibrated. From these data, one can derive a table showing the expected value of each pixel of the image, for each particular color and at each particular level of illumination. Such tables are what is represented in block 4002.

Next, the color corrected images are sent through a series of processing steps to isolate various spectral characteristics (Blocks 5001-5003) detailed in FIG. 5. FIG. 5 provides an expanded description of what is performed in block 4003 of FIG. 4.

Next, the specific region of interest is extracted, in Block 4005, and stereo processing functions are performed, in Block 4006, as detailed later, in FIG. 6, where the first passive ranging estimates are computed. The step of ranging includes calculating the distance from the camera to the object of interest, using multiple cameras and multiple images, as indicated in Block 4006 of FIG. 4, and which is further covered in FIG. 6. Potential targets are extracted from the regions of interest in Block 4007 and adaptive thresholds are applied to eliminate false targets, in Block 4008. Finally, positive detections are merged into a single swimmer centroid, in Block 4009, and final range estimates are computed in Block 4010.

FIG. 5 provides a flow chart showing the steps performed by the pool monitoring algorithm during the spectral processing phase (represented by block 4003 of FIG. 4). A series of estimates are made of the color covariance, in Block 5000, and are used to determine the principal components of the image, in Block 5001. Next, eigen images are constructed, in Block 5002, to isolate the colors indicative of potential swimmers, and a test statistic is computed, in Block 5003. The test statistic helps to determine the thresholds used to differentiate swimmers from the background in the combined ratio color image, in Block 5004.

FIG. 6 provides a flow chart showing the steps performed by the processor (item 6 of FIG. 2) to determine the range to detected targets in the water. FIG. 6 provides an expanded description of what is performed in block 4006 of FIG. 4. Each image is rectified, in Block 6000, and sub-pixel registration points are computed, in Block 6001, to enable proper image matching. Next a Snell compensation filter is applied, in Block 6002, to account for and overcome the surface refractive effects of the air-water interface. A spatial estimator is computed in Block 6003, and a statistical quality test is performed, in Block 6004, to determine the effectiveness of the spatial estimator. This process continues until the system has a quality estimate of the spatial extents of the targets in the water, in Block 6005.

In summary, the system and method of the present invention overcomes the technical challenges associated with detecting, tracking, and discriminating among objects on or under water, using a video surveillance system which is disposed above the surface of the water. The major problems associated with an above-water system are the following:

a) variations in ambient light levels cause changes in the amplitude of signals received;

b) refraction in calm water causes distortion of the images received;

c) refraction and glint, for small and large water waves on the surface, cause distortion of the images received;

d) the images received may be of poor quality, due to a low signal-to-noise ratio; and e) attenuation through the water will be different for different frequencies of light, thus causing distortion of certain color components of signals received.

These problems are addressed by the present invention as follows.

The problem of dealing with variations in ambient light levels is the subject of illumination component A2.1.4 of FIG. 3.

The variation, over time, of the ambient light level is monitored using an incident light sensor (ILS), which provides a calibrated measure of the radiant energy over specific wavebands of interest. Since the detection processing methodology of the present invention uses the spectral information in the captured video, it is important to adjust engineering parameters in the multi-spectral image processing chain, as needed, to compensate for these variations. As an example the local detection thresholds, for both the spectral image processing and the spatial image processing, would be a function of, and adaptive to, the overall light level.

Cameras can adjust automatically the gain of an image detector to maximize image fidelity. Doing so, however, obscures the actual level of incident light from any downstream processing because the auto-gain value is not known for each frame. The present invention instead uses an incident light sensor (ILS), separate from the camera imagers to get a light level reading on a known scale.

The issue of compensation for refraction is the subject of block 6002 of FIG. 6, which is part of block 4006 of FIG. 4, which in turn is part of block A2.2.2 of FIG. 3.

With regard to compensation for refraction in calm water, the present invention works as follows. As light passes from one material medium to another, in which it has different speeds, e.g. air and water, the light will be refracted, or bent, by some angle. The common apparent "broken leg" observed as one enters a pool is evidence of this. Since the speed of light in water is less than the speed of light in air, the angle of refraction will be smaller than the angle of incidence as given by Snell's law.

Snell's law can be stated as:

$$N_1 \sin A = N_2 \sin B$$

where $N_1$ and $N_2$ are the refractive indices of the two media involved (in this case, water and air), and A and B are the angles of incidence and refraction. The observed position of an object can be used to derive an angle of refraction, and, since the refractive indices of water and air are known, Snell's law can therefore be used to calculate the angle of incidence, and hence the correct position of the observed object.

Thus, objects which are under water, and which are viewed from above water, will appear to be closer by an amount given by Snell's law, since the water acts as a lens, refracts the light and in this case magnifies the object with positive power, which for water is about 1.33. For light reflected from an object and going from water to air, the actual depth D is 1.33 times the apparent depth.

The system of the present invention therefore applies Snell's law, in reverse, as described above, for each pixel, to correct properly its position in three-dimensional space. That is, the system of the present invention uses Snell's law to determine exactly how an image was refracted, so as to determine the actual position of each pixel representing the object.

The issue of compensation for glint, and for refraction in small or large water waves, is illustrated by the same drawings as for the case of refraction in calm water.

With respect to compensation for refraction and glint for small and large water waves on the surface, Snell's law is again used for the refraction component, and frame-to-frame averaging is also used.

Specifically, a sequence of images is collected, and any glint is reduced by polarized optical filters. The de-glinted images are then statistically analyzed to determine the pixels in each image that have minimal distortion due to refraction and are not still obscured by glint that was reduced through the physical filters. The algorithm discards those pixels in regions of an individual image which indicate high distortion or obscuration creating an area of "no data" for that image. This prevents regions with no useful data from weakening the correlation of the other parts of that image. It also keeps the data from those distorted/obscured zones from weakening the correlation with the corresponding regions in images just prior or later in the time sequence.

A single derived image is reconstructed from the initial sequence of distorted images. In this way, one can reconstruct an image using pixels from several images, using only those pixels not affected by the small and large surface waves. The result has only to account for the normal refraction, using Snell's law.

In this way, one can reconstruct an image using pieces from several images, using only those portions not affected by the small and large surface waves. The result has only to account for the normal Snell's law effects compensated for previously.

The system of the invention addresses the problem of improving image quality as follows. This methodology is represented in blocks 4003 and 4004 of FIG. 4, and block A2.2.2 of FIG. 3.

The starting point for image enhancement is the decomposition of the video image into its principal components (PC). A given raw image of video is composed of red, blue and green color components. The sum of those three components comprises the actual color image seen by a viewer. The three colors for a particular image may in fact contain redundant information. Decomposing an RGB image into its principal components is a known statistical method used to produce three pseudo-color images containing all the information in the RGB image. The information is separated so each image is uncorrelated from the others but contains pertinent information from the original image. The PC images are then filtered, using a priori spectral information (i.e. how an expected target should appear in the pseudo color images) about features of interest. The extraction method uses a threshold value where a PC pixel is deemed to be a feature of interest or target if it exceeds the threshold.

The reason why the three color components (red, blue, green) contain redundant information is that the color components, in general, for natural backgrounds or scenery, are correlated. The object of principal component analysis is to find a suitable rotation in the three-dimensional "color space" (i.e. red, green, blue) which produces three mutually uncorrelated images. These images may be ordered so that the first PC image has the largest variance PC1, the second image has the next largest variance (designated PC2), and the last image has the smallest variance, designated PC3. The variance, power, is a measure of the dispersion, or variation of the intensity values, about their mean value. Since PC1, PC2, and PC3 are all uncorrelated with each other, PC1 which has the largest variance or power, will generally have the largest contrast enhancement, while the other two will have less contrast. Furthermore, the orthogonality of the components can be used to aid in discrimination of particular features.

In particular, looking at functions of the individual intensity values of the PC components can allow discrimination and segmentation of the resulting thresholded image.

For example, consider pixel-wise ratios, where R(i,j) refers to the (i,j)-th location in the image array, and define the following:

$$R1(i,j)=PC1(i,j)/PC2(i,j),$$

$$R2(i,j)=PC1(i,j)/PC3(i,j), \text{ and}$$

$$R3(i,j)=R2(i,j)/R1(i,j).$$

Using properly established thresholds, say T1, T2, and T3, which are defined by what spectral features are desired to be enhanced, based on a priori knowledge, optics, and the physics of the reflected light, the following spectral filter or statistic, can be used to extract features of interest:

$$\text{Test Image}(i,j)=1 \text{ for } (R1(i,j)>T1 \text{ and } R2(i,j)>T2 \text{ and } R3(i,j)>T3)$$

$$\text{Test Image}(i,j)=0 \text{ otherwise, and}$$

$$\text{Output Image}(i,j)=\text{Test Image}(i,j)*\text{RGB Image}(i,j),$$

the latter calculation indicating pixel-wise multiplication.

This principal components analysis is performed in blocks 5001-5003 of FIG. 5, which is part of block A2.2.2 of FIG. 3.

To further enhance the signal-to-noise ratio, a spatial filter is used on the PC images to enhance spatial shape information. Again, a priori shape filters are used for this. The output of the spatial filter is used to initiate a track of a candidate target and the track is updated sequentially, in time. The spatial match filter is an optimum statistical test which maximizes the signal to noise ratio at locations where a target or feature is present.

More particularly, the spatial filter used in the present invention measures the correlation between a known shape and the image being analyzed. Thus, one must know in advance the shape of the target being searched, up to a scale factor. The procedure comprises a pattern matching process, where a known spatial pattern is convolved with an input image to yield an output of SNR (signal-to-noise ratio) values.

For example, suppose that it is desired to detect a square shape in an image that contains that shape plus added noise. One begins with a template comprising a white square in a black image. That is, the pixels in the square have a value of one (maximum brightness) and the pixels elsewhere are zero (black). Shifted versions of this template are used to locate the square pattern in the raw image.

To start the correlation processing, the match filter output at that location will be the sum of the pixel-wise product of the template image with the raw image. For each template, the sum will be the sum of the pixel values in the image being analyzed, but only in the square corresponding to that of the template. Then, a new template is created in which the square is shifted one pixel to the right, and the process is repeated. The process continues for each row in the raw image.

For targets which may have a particular orientation, all possible orientations of the template must be considered. So for a rectangular target, if the orientation is not known, one must rotate the template and perform the processing for each orientation. The number of rotations depends on the amount of accuracy required. If ten-degree accuracy is sufficient, one needs 18 such steps, i.e. each template being rotated by ten degrees. The latter would cover all possible orientations in the plane.

The spatial analysis described above yields correlation values for each comparison performed. These correlation values can then be used to determine whether the image being analyzed contains the desired target shape.

The above-described analysis is covered by block 4004 of FIG. 4, and block A2.2.2 of FIG. 3.

The present invention addresses the issue of color attenuation through water as follows. This issue is covered in block 6002 of FIG. 6, block 4006 of FIG. 4, and block A2.2.2 of FIG. 3.

Because wavelengths of light are attenuated to varying degrees through water, some are not useful for processing to detect targets underwater. Instead, as mentioned in the prior PC discussion, some add no additional information to the image and can be ignored. Ignoring some of these wavelengths reduces the processing required to detect and track targets and speeds up the processing algorithm. It has been found that there may be little difference between the information content of the blue and green wavebands in the imagery, and thus one can variously ignore one of them, average them, or sum them to enhance the signal-to-noise ratio of the image, without altering the algorithm's perception of potential targets.

The process of the present invention can be summarized as follows. The process includes three basic parts, designated as 1) spectral processing, 2) spatial processing, and 3) temporal processing. These parts are interrelated, insofar as the output of one part is used as the input to the next.

The spectral processor decomposes each digital image into its principal components, using known techniques, as explained above. The value of principal components analysis is that the images resulting from the procedure have enhanced contrast, or signal-to-noise ratio, and are preferably used instead of the original images.

The output from the spectral processor is fed to the spatial processor. The spatial processor searches for particular shapes in each image, by comparing a particular shape of interest, with each portion of the image, in order to determine whether there is a high correlation. The shapes of interest are stored in memory, and are chosen to be relevant to the problem of finding possible drowning victims. Thus, the shapes could comprise human forms and the like.

The output of the spectral processor is fed into a temporal processor, which analyzes a sequence of images, to detect movements that may indicate drowning. That is, for those images containing shapes of interest, such as human forms, the system must determine whether those forms are moving in ways which would indicate drowning. The movements of interest could include pure vertical motion, or vertical motion combined with rotation.

For a given sequence of images, the system can generate a discrimination statistic, i.e. a number representing the extent to which the sequence of images contains any of the prestored movements indicative of drowning. If a sequence of images produces a statistic which exceeds a predetermined threshold, i.e. if the statistic indicates that the relevant movements are likely to be present, an alarm can be generated. The statistic can be generated from a mathematical model representing the motions of interest.

The temporal processor depends on the output of the spatial processor insofar as the shapes of interest, detected by the spatial processor, are then analyzed to see whether such shapes are moving in a manner that would suggest drowning.

In addition to all of the above, the system is programmed to compare sequential images to determine which pixels, if any, are artifacts due to glint. Such pixels can be discarded to improve the quality of the images. This procedure can include an adaptive filter, in that its steps may be executed only if obscurations and/or excessive refraction distortions are detected through pre-set criteria.

For example, suppose an individual is swimming in a pool. The spectral processor will enhance the images of the swimmer so that the swimmer can be automatically recognized as such by the system. Further processing by the spatial match filter would extract information concerning the size, shape, and location of the swimmer. This information is passed to the temporal processor, which considers the incoming time series of images, and computes a statistic which indicates the degree to which the motions of the swimmer match the motions, stored in memory, indicative of drowning. If the statistic is above a given threshold, i.e. if the detected motions of the human form have a high correlation with motions known to be associated with drowning, the system generates an alarm.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but should include all embodiments and methods within the scope and spirit of the following claims.

What is claimed is:

1. A system for monitoring swimming pools for possible drowning victims, the system comprising:

a) a passive sensor, positioned above a surface of a pool, the sensor comprising means for receiving an image of an object located at or below the surface of the pool, b) means for digitizing images received from the sensor, c) a programmable computer connected to receive data from the digitizing means, the computer being programmed to analyze the images to determine whether the images indicate a presence of a drowning victim in the pool, and d) means for alerting an operator of the presence of a drowning victim, wherein the computer comprises entirely passive means for compensating for refraction of images caused by a roughened water surface due to surface waves in the pool, wherein the water surface defines a plurality of areas having different refraction properties, wherein the computer comprises:

e) a spectral processor for decomposing each image into principal components, f) a spatial processor which receives input from the spectral processor, the spatial processor comprising means for detecting predetermined shapes in the images, and g) a temporal processor which receives input from the spatial processor, the temporal processor comprising means for analyzing sequences of images and for detecting the presence of predetermined movements of said predetermined shapes in said sequences of images, wherein said predetermined shapes comprise human forms, and wherein said predetermined movements comprise vertical movements and vertical movements with rotation.

2. The system of claim 1, wherein there are at least two sensors, and wherein the computer comprises means for comparing images received by the sensors so as to compute a distance to an object in said images.

3. The system of claim 1, wherein the computer comprises means for enhancing quality of images by extracting principal components of the images, wherein said principal components are non-correlated, and analyzing at least some of said principal components to derive information about the images.

4. A method for monitoring swimming pools for possible drowning victims, the method comprising:

a) forming a sequence of digital images of a pool, each image being formed by a passive sensor positioned above a surface of the pool, the sensor comprising means for receiving an image of an object located at or below the surface of the pool, b) analyzing said images to determine whether the mages indicate a presence of a drowning victim in the pool, and C) alerting an operator of the presence of a drowning victim, wherein step (b) includes passively compensating for refraction of images caused by a roughened water surface due to surface waves in the pool, wherein the water surface defines a plurality of areas having different refraction properties, wherein step (b) includes:

d) decomposing each image into principal components, e) analyzing each image component produced in step (d) to detect predetermined shapes in said image component, and f) analyzing sequences of image components obtained from step (e) to detect predetermined movements of said predetermined shapes in said sequences of image components, wherein said predetermined shapes are selected to the human forms, and wherein said predetermined movements are selected form the group consisting of vertical movements and vertical movements with rotation.

5. The method of claim 4, wherein there are at least two sensors, and wherein step (b) includes comparing images received by the sensors so as to compute a distance to an object in said image.

6. The method of claim 4, wherein step (b) includes enhancing quality of images by extracting principal components of the images, wherein said principal components are non-correlated, and analyzing at least some of said principal components to derive information about the images.

7. A method of monitoring a pool so as to detect possible drowning victims therein, the method comprising:

a) forming a sequence of digital images of a pool, each image being formed by a passive sensor positioned above a surface of the pool, the sensor comprising means for receiving an image of an object located at or below the surface of the pool, b) decomposing each image into principal components so as to enhance quality of said images, c) analyzing at least some principal components obtained from step (b) to detect a presence of predetermined shapes in said image, d) analyzing sequences of images having been found to be likely to contain said predetermined shapes, to detect predetermined movements associated with drowning, wherein the analyzing steps include passively compensating for refraction of images caused by a roughened water surface due to surface waves in the pool, wherein the water surface defines a plurality of areas having different refraction properties, and e) alerting an operator of the existence of a possible drowning event when said predetermined movements are detected.

* * * * *